United States Patent [19]

Nusbaum

[11] 4,010,543

[45] Mar. 8, 1977

[54] HOLE CUTTING APPARATUS

[76] Inventor: Max J. Nusbaum, 30 Arlo Road, Staten Island, N.Y. 10301

[22] Filed: Oct. 28, 1975

[21] Appl. No.: 626,311

[52] U.S. Cl. ..... 30/316; 30/113.1

[51] Int. Cl.[2] ..... B26B 3/00

[58] Field of Search ..... 30/113.1, 113.2, 113.3, 30/316

[56] References Cited

UNITED STATES PATENTS

| | | | |
|---|---|---|---|
| 158,420 | 1/1875 | Knapp | 30/113.1 |
| 185,902 | 1/1877 | Fallows | 30/113.1 |
| 511,803 | 1/1894 | Scales | 30/113.1 |
| 1,270,040 | 6/1918 | Miller | 30/316 X |
| 1,277,308 | 8/1918 | Gunturiz | 30/278 X |
| 1,774,551 | 9/1930 | Hackett | 30/124 X |
| 2,402,558 | 6/1946 | La Berge | 30/113.3 |
| 2,708,312 | 5/1955 | Hauser | 30/124 |
| 2,990,615 | 7/1961 | Ohler | 30/113.1 |
| 3,335,473 | 8/1967 | Gentoso | 30/124 |
| 3,639,981 | 2/1972 | Nowensky | 30/124 |

FOREIGN PATENTS OR APPLICATIONS

| | | | |
|---|---|---|---|
| 434,599 | 10/1967 | Switzerland | 30/113.1 |

*Primary Examiner*—Al Lawrence Smith
*Assistant Examiner*—J. T. Zatarga
*Attorney, Agent, or Firm*—Richard L. Miller

[57] ABSTRACT

A hole cutting apparatus which can be utilized to make holes in material which is of a tacky nature, including a hollow tube whose bottom edge is both chamfered and also cut at an angle with respect to the longitudinal axis of the tube. A knob is coupled to the top of the tube to form a handle. A hole in the top of the knob prevents a vacuum from being formed in the tube and also permits easy removal of the portion cut.

9 Claims, 5 Drawing Figures

HOLE CUTTING APPARATUS

BACKGROUND OF THE INVENTION

This invention relates to hole cutting apparatus, and more particularly to a hole cutter which can be used to cut holes in a tacky, gum like substance, such as seal rings utilized in surrounding the stoma of an ostomy appliance.

The prior art includes many types of hole cutters and punchers designed for specific material and specific uses. As is well known, there are various ways of forming a hole in a material. One method is by punching the hole by using a solid puncher. The hole is formed by applying pressure, and frequently impulse force, to the solid puncher to knock out a hole in the material. Another well known method of forming holes involves cutting the hollow by using a hole tube having a cutting edge. The tube is pressed down and shears the material being cut. Depending upon the type of material, an appropriate type of cutter or puncher will be selected. For example, if the material is thin and stiff, such as paper or cardboard, a hole puncher can be utilized. On the other hand, if the material is soft, such as fruits and vegetables, a hole cutter will be utilized which shears through the material. Such hole cutters are frequently utilized for removing the core of fruit and/or vegetables.

A more difficult situation occurs when the material to be cut is tacky and sticky, such as for example, clay, gum, pottery, etc. Such material is not hard enough to utilize a puncher since the hole puncher would merely deform the material but would not form a hole therein. On the other hand, the material is not soft enough to be sheared by using a hollow tube hole cutter. In order to form holes in such thick, tacky material, the prior art has suggested various solutions which generally relate to slicing a hole through the material rather than by just shearing it. Such prior art devices have suggested forming serrated edges or notches along the cutting edge of the hollow tube. The hollow tube is then inserted into the clay-like material and the tube is rotated, so that the sharpened, serrated edges or notches can slice around the material and form a hole therein.

However, because of the serrated edges, the hole cutters have become more expensive to manufacture and because rotation of the hole cutters is required, they become more difficult to use. Furthermore, the serrated or notched edges may be suitable when the material is thick, such as in connection with pottery. However, when a very thin layer of this material is to be cut, the serrated edge will not provide a smooth cut and a rather rough edge will result. Also, it will frequently deform the material while making the hole therein.

One particular material is most difficult to work with is the seal ring which is placed around the stoma of an ostomy appliance. An ostomy generally refers to the surgical operation which creates a new outside opening for body wastes called a stoma. Various types of ostomy operations are well known, such as the colostomy the ileostomy and the ureterostomy. In all cases, an opening is made in the body to permit removal of waste products. A person with such a stoma must usually wear an ostomy appliance, which is a collecting device. The appliance must be connected to the stoma to prevent leakage from the stoma, and at the same time not exert pressure on the stoma. One of the most important aspects of taking care of the patients well being is to properly measure the stoma to select the proper sized appliance. If the appliance has too small an opening it will place a strain on the stome. Too large an opening will expose the skin around the stoma and allow irritation to take place. In order to properly fit the appliance to the stoma, a seal ring is utilized. This seal ring is made out of a gum like material chosen for its ability to protect the skin against the inflaming digestive fluids. The seal is frequently made out of a type of karaya gum powder which is sticky and tacky. The material is affected by heat and moisture so that in winter weather the seal will be firm and less tacky while during warmer weather it will again become moist and tacky.

Since stomas can be made in various sizes, the hole in the seal ring must fit exactly the stoma. One method is to purchase precut seal rings and place them between the stoma and the appliance. However, such precut seal rings are extremely expensive since they must be formed in numerous sizes. Also, since only a limited number of such sizes can be made available, many times there will be a slight space between the seal and the stoma causing difficulty to the patient. Another method is to buy a solid circular seal and for the patient to form the hole in the seal by himself, in accordance with the stoma size needed. This method is generally desired since it izs cheaper to buy a standard circular seal, and also the hole can be formed to exactly fit the stoma. However, it is extremely difficult to make a hole in this gum like material. In most cases a scissor is utilized, but as is well known, it is difficult to make a perfect circle using a scissor. Prior art hole cutters are also difficult to utilize since the material of the seal is a substance which is awkward for both hole punchers and hole cutters, and using a hole cutter which must be rotated, tends to distort the ring.

The problem is even further aggravated in that the seal usually comes in a plastic case. In order to make the hole in the ring, it is necessary to either cut through the plastic case together with the seal, or to try to cut the hole in the seal without cutting into the plastic case. This entire situations presents a most difficult problem for hospitals, clinics, as well as individual patients. The cutting of holes in the gum like seals has therefore been a very time consuming and taxing task which provides much aggravation to all those requiring such seals.

SUMMARY OF THE INVENTION

It is accordingly an object of the present invention to provide a hole cutting apparatus which avoids the aforementioned problems of prior art devices.

It is a further object of the present invention to provide a hole cutting apparatus which can be used to make holes in sticky, gum like material.

It is another object of the present invention to provide a hole cutting apparatus with an improved cutting edge which can slice through material without rotating the apparatus.

Still a further object of the present invention is to provide a hole cutting apparatus which includes both a hole cutter and a base plate which maintains the cutting edge in a sharp state.

A further object of the present invention is to provide a hole cutting apparatus which can be used to make circles in seal rings for placing around the stoma of a colostomy.

Another object of the present invention is to provide a hole cutting apparatus which is simple in construction, inexpensive to manufacture and easy to use.

A further object of the present invention is to provide a hole cutting apparatus which has a tube and a knob, and wherein the knob includes a hole which can be used to prevent a vacuum forming in the tube, to eject the material cut, as well as a holder during electropolishing of the apparatus.

These and other objects, features and advantages of the invention, will, in part, be pointed out with particularity, and will, in part, become obvious from the following more detailed description of the invention, taken in conjunction with the accompany drawings which forms an integral part thereof.

Briefly, the invention comprises a hole cutting apparatus including a hollow tube having a top and bottom end. The bottom end of the tube is chamfered and is also cut at an angle with respect to the longitudinal axis of the tube to form a cutting edge. A knob is coupled to the top end of the tube to form a handle.

In one embodiment of the invention, the knob is of hemispherical shape and includes a hole formed in the approximate center thereof. A base plate can be included to support the material being cut and also to provide a penetratable substance in which to bottom end of the hole cutting edge can enter.

BRIEF DESCRIPTION OF THE DRAWINGS

In the drawing.

In the various figures of the drawing, like references characters designate like parts.

DESCRIPTION OF THE PREFERRED EMBODIMENT

Figure 1:
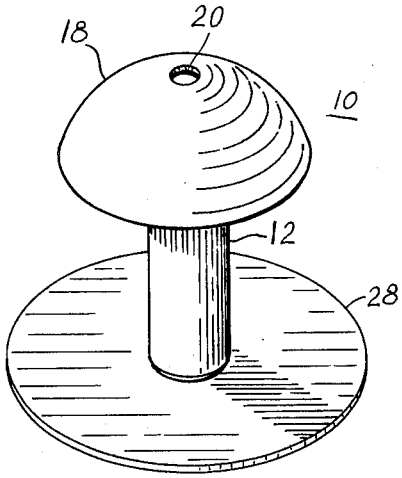
FIG. 1 is an isometric top view of the hole cutting apparatus in accordance with the present invention.
Figure 3:
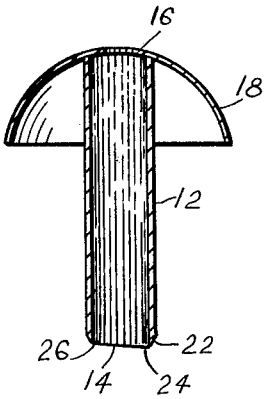
FIG. 3 is a sectional elevational view taken along line 3—3 of FIG. 2.
Figure 2:
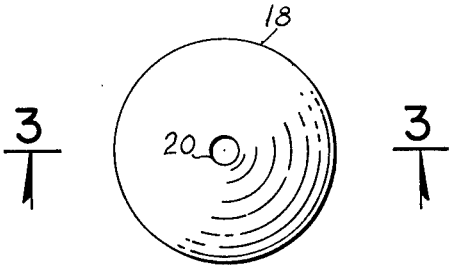
FIG. 2 is a top view of the apparatus.

The hole cutting apparatus of the present invention finds particular use in cutting material which is sticky, and gum-like which cannot generally be punched through or sheared. The present apparatus provides an improved cutting edge which can be effectively used to slice through the material without the necessity of rotating the device, and only by applying a downward pressure on the apparatus.

The hole cutting device is shown generally at 10 and includes a hollow shaft-like tube 12 having a bottom end 14 and a top end 16. A knob 18 is coupled to the top end of the tube. The knob can be in the shape of a partial sphere, shown by way of example, as a hemispherical shape. In the approximate center of the knob there is formed a hole 20. The hole extends through the entire thickness of the knob so that it can cooperate with the hollow portion of the tube.

The bottom end of the tube is chamfered at 22, and is also cut at an angle with respect to the longitudinal axis of the tube such that the end 24 is lower than the edge 26. As a result of the combination of the chamfering and the cutting of the bias, the end 24 will have a longer chamfer than the end 26.

Figure 4:
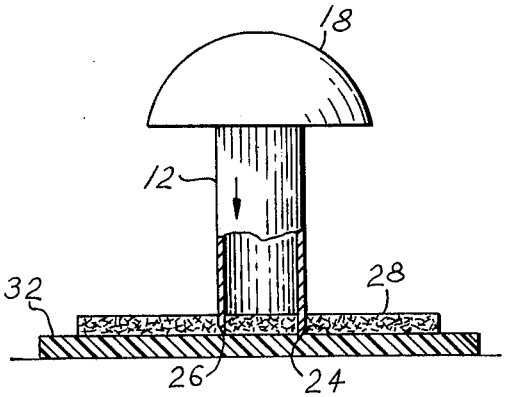
FIG. 4 is a partially cut-away elevational view showing the insertion of the apparatus to cut a hole.
Figure 5:
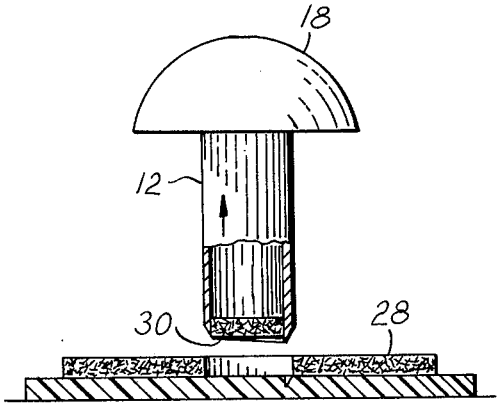
FIG. 5 is a partially cut-away elevational view showing the removal of the apparatus after a hole is cut.

The operation of the apparatus can best be understood with reference to FIGS. 4 and 5. The apparatus is first inserted into the material 28 to be cut and is pushed with a downward force as shown by the arrow. Because of the chamfering of the edge, the cutting edge formed will easily pass into the material 28 being cut. Additionally, because the bottom end of the tube is cut on a bias, the lower end 24 will enter the material first and then the higher end 26 will enter thereafter. The cutting of the tube along the bias permits entry of the bottom end of the tube into the material and causes slicing action. After the hole has been cut in the material 28, the cut piece 30 will remain on the inside of the hollow tube by means of friction, and because of the sticky and tacky nature of the material itself. As the hole cutting apparatus if lifted from the material, the cut portion 30 will remain in the tube and can later be removed and thrown away.

By combining the chamfering and cutting on the bias, it has been found that the cutting apparatus of the present invention can be utilized with such sticky and tacky material such as gum, clay, etc., without the need of rotating the apparatus. The combination of the chamfer and the cutting on the bias will therefore effectively produce a slicing action similar to that produced by rotating a serrated edge. However, when utilizing the serrated edge, the apparatus must be rotated within the material. Such rotation is avoided by using the combination of chamfered and biased edge, in accordance with the present invention.

In order to maintain a sharpened edge, the present invention can include a base plate 32 which can both support the material being cut and can also serve as a penetratable means for the hole cutting apparatus. As the apparatus is inserted through the material being cut it can penetrate into the base plate 32. Since one end of the cutting edge 24 is at a lower plane than the opposite edge 26, the lower edge 24 will, of course, penetrate deeper into the base plate 32. In fact, the edge 24 will penetrate into the base plate while the opposite edge 26 is still cutting the material 28. By selecting the base plate properly, it can provide the proper penetrating ability for the cutting edge, and at the same time not dull the cutting edge for further operation.

The hole 20 contained in the top portion of the knob can be utilized for a plurality of reasons. Firstly, it prevents a vacuum from being formed in the tube. This vacuum would tend to prevent the tube from accepting additional cut material. Furthermore, it provides means through which a sharp object can be inserted to push out the portion cut away. With most hole cutting apparatus, there is a final step in its manufacture which requires the polishing of the apparatus. This polishing is ofter done by means of an electropolishing process. The hole 20 can therefore be utilized in connection with the electropolishing process by inserting a holder into the hole 20, so that the hole cutting apparatus can be held as one of the electrodes during the electropolishing process.

In one embodiment of the present invention, the tube and knob are made out of stainless steel and the base plate is made out of a plastic material. The dimensions of the tube can typically vary from approximately ¾ inches in diameter to 3 inches in diameter depending on the size of the hole which is to be cut. The diameter of the knob can typically be approximately 3 inches, and its height approximately 1¼ inches. The total height of the tube can be typically approximately 4 inches high. A 6 by 6 inch plastic can be utilized as the base plate and approximately 3/16th inch thickness is sufficient to support the material and the penetration of the cutting edge.

There has been disclosed heretofore the best embodiment of the invention presently contemplated. However, it is to be understood that various changes and modifications may be made thereto without departing from the spirit of the invention.

What is claimed is:

1. A hole cutting apparatus comprising, a hollow tube having a top and bottom end, said bottom end being chamfered on the outer surface completely around the circumference thereof and being cut at a shallow angle with respect to a plane transverse to the longitudinal axis of the tube to form a cutting edge, said cut of said bottom end being less than the angle of the chamfer, whereby one portion of the bottom end has a greater chamfer than the rest of the bottom end, and a knob coupled to the top end of the tube to form a handle.

2. A hole cutting apparatus as in claim 1 and wherein said knob is of a hemispherical shape.

3. A hole cutting apparatus as in claim 2 and wherein said knob includes a hole formed in the approximate center thereof and positioned over the hollow portion of said tube.

4. A hole cutting apparatus as in claim 1 and wherein said tube and said knob are of stainless steel material.

5. A hole cutting apparatus as in claim 4 and wherein said stainless material has been electropolished.

6. A hole cutting apparatus as in claim 1 and further comprising support means for retaining the material being cut, said support means cooperating with said cutting edge during the cutting of the material for providing a penetratable substance in which the cutting edge can enter after the cutting of the material.

7. A hole cutting apparatus as in claim 6 and wherein said support means is of a plastic material.

8. A hole cutting apparatus comprising, in combination: a tool including a hollow tube having a top and bottom end, said bottom end being chamfered on the outer surface completely around the circumference thereof and being cut at an angle with respect to a plane transverse to the longitudinal axis of the tube to form a cutting edge, said cut of said bottom end being less than the angle of the chamfer whereby one portion of the bottom end has a greater chamfer than the rest of the bottom end, and a knob coupled to the top end of the tube for forming a handle; and a support plate for retaining the article being cut, said support plate cooperating with said cutting edge during the cutting of the material by providing a penetratable surface in which the cutting edge can enter after cutting of the material.

9. A hole cutting apparatus as in claim 8 and wherein said knob includes a hole formed therein and positioned over the hollow portion of said tube.

* * * * *